US007706544B2

(12) United States Patent
Melchior et al.

(10) Patent No.: US 7,706,544 B2
(45) Date of Patent: Apr. 27, 2010

(54) AUDIO REPRODUCTION SYSTEM AND METHOD FOR REPRODUCING AN AUDIO SIGNAL

(75) Inventors: Frank Melchior, Ilmenau (DE); Thomas Röder, Rockhausen (DE); Michael Beckinger, Erfurt (DE); Sandra Brix, Ilmenau (DE); Thomas Sporer, Fürth (DE); Haymo Kutschbach, Berlin (DE); Berthold Schlenker, Ilmenau (DE); Carsten Land, Ilmenau (DE)

(73) Assignee: Fraunhofer-Gesellschaft zur Forderung der Angewandten Forschung E.V., Munich (DE)

( * ) Notice: Subject to any disclaimer, the term of this patent is extended or adjusted under 35 U.S.C. 154(b) by 1391 days.

(21) Appl. No.: 11/099,156

(22) Filed: Apr. 5, 2005

(65) Prior Publication Data

US 2005/0175197 A1 Aug. 11, 2005

Related U.S. Application Data

(63) Continuation of application No. PCT/EP03/13110, filed on Nov. 21, 2003.

(30) Foreign Application Priority Data

Nov. 21, 2002 (DE) ..... 102 54 404

(51) Int. Cl.
*H04R 5/00* (2006.01)
*H04R 5/02* (2006.01)

(52) U.S. Cl. ..... 381/18; 381/17; 381/19; 381/307; 381/310

(58) Field of Classification Search ..... 381/17, 381/18, 19, 309, 310, 27, 61, 307
See application file for complete search history.

(56) References Cited

U.S. PATENT DOCUMENTS 5,598,478 A * 1/1997 Tanaka et al. ..... 381/17

(Continued)

FOREIGN PATENT DOCUMENTS

JP 4132499 5/1992

(Continued)

OTHER PUBLICATIONS

Marinus M. Boone; "Acoustic rendering with wave field synthesis"; ACM SIGGRAPH and Eurographics Campfire: Acoustic Rendering for Virtual Environments; May 29, 2001; pp. 1-9; Snowbird, Utah, USA.

(Continued)

*Primary Examiner*—Vivian Chin
*Assistant Examiner*—Douglas J Suthers
(74) *Attorney, Agent, or Firm*—Daniel J. Santos

(57) ABSTRACT

An audio reproduction system is divided into a central wave-field synthesis module and a plurality of loudspeaker modules disposed in a distributed way, wherein synthesis signals for the individual loudspeakers as well as corresponding channel information associated to the synthesis signals are calculated in the central wave-field synthesis module. The synthesis signals for a loudspeaker as well as associated channel information will then be transmitted to respective loudspeaker modules via a transmission path, wherein every loudspeaker module obtains the synthesis signals and associated channel information intended for the loudspeaker associated to the loudspeaker module. A distributed audio rendering and digital/analog converting takes place in the loudspeaker module to generate the actually analog loudspeaker signals in a distributed way in spatial proximity to every loudspeaker. The division into a central wave-field synthesis module and the plurality of distributed loudspeaker modules allows that audio reproduction systems that are scalable with regard to the price can be generated in order to offer systems of different size scalable in price particularly for cinema reproduction rooms varying strongly in size.

20 Claims, 6 Drawing Sheets

U.S. PATENT DOCUMENTS

| | | | | |
|---|---|---|---|---|
| 5,983,087 | A * | 11/1999 | Milne et al. | 455/149 |
| 6,584,204 | B1 | 6/2003 | Al-Ali et al. | |
| 6,608,903 | B1 * | 8/2003 | Miyazaki et al. | 381/17 |
| 6,766,028 | B1 * | 7/2004 | Dickens | 381/310 |

FOREIGN PATENT DOCUMENTS

| | | |
|---|---|---|
| JP | 4287528 | 10/1992 |
| JP | 5244683 | 9/1993 |
| JP | 7222299 | 8/1995 |
| JP | 7236200 | 9/1995 |
| JP | 2001169309 | 6/2001 |
| JP | 2001-517005 | 10/2001 |
| JP | 2001275194 | 10/2001 |
| WO | WO 01/23104 A2 | 4/2001 |

OTHER PUBLICATIONS

Horbach, Ulrich et al.; "Real-time Rendering of Dynamic Scenes Using Wave Field Synthesis"; Proceedings 2002 IEEE International Conference on Multimedia and Expo (Cat. No. 02TH8604); Proceedings of IEEE International Conference on Multimedia and Expo (ICME); Aug. 26-29, 2002; pp. 517-520; Lausanne, Switzerland.

Berkhout, A. J. et al.; "Acoustic control by wave field synthesis"; Journal of the Acoustical Society of America, American Institute of Physics; May 1993; pp. 2764-2778; vol. 93, No. 5; New York, USA.

Marinus M. Boone et al.; "Spatial Sound-Field Reproduction by Wave-field Synthesis"; Delft University of Technology Laboratory of Seismics and Acoustics, Journal of J. Audio Eng. Soc.; vol. 43, No. 12; Dec. 1995; pp. 1003-1012; The Netherlands.

Diemer De Vries; "Sound Reinforcement by Wavefield Synthesis: Adaptation of the Synthesis Operator to the Loudspeaker Directivity Characteristics"; Delft University of Technology Laboratory of Seismics and Acoustics; Journal of J. Audio Eng. Soc.; vol. 44, No. 12; Dec. 1996; pp. 1120-1131; The Netherlands.

Werner P.J. De Bruijn et al.; "Subjective experiments on the effects of combining spatialized audio and 2D video projection in audio-visual systems"; Delft University of Technology Laboratory of Acoustic Imaging and Sound Control; Audio Engineering Society, Convention Paper 5582; Presented at the 112$^{th}$ Convention May 10-13, 2002 in Munich, Germany; pp. 1-11; New York, New York, USA.

* cited by examiner

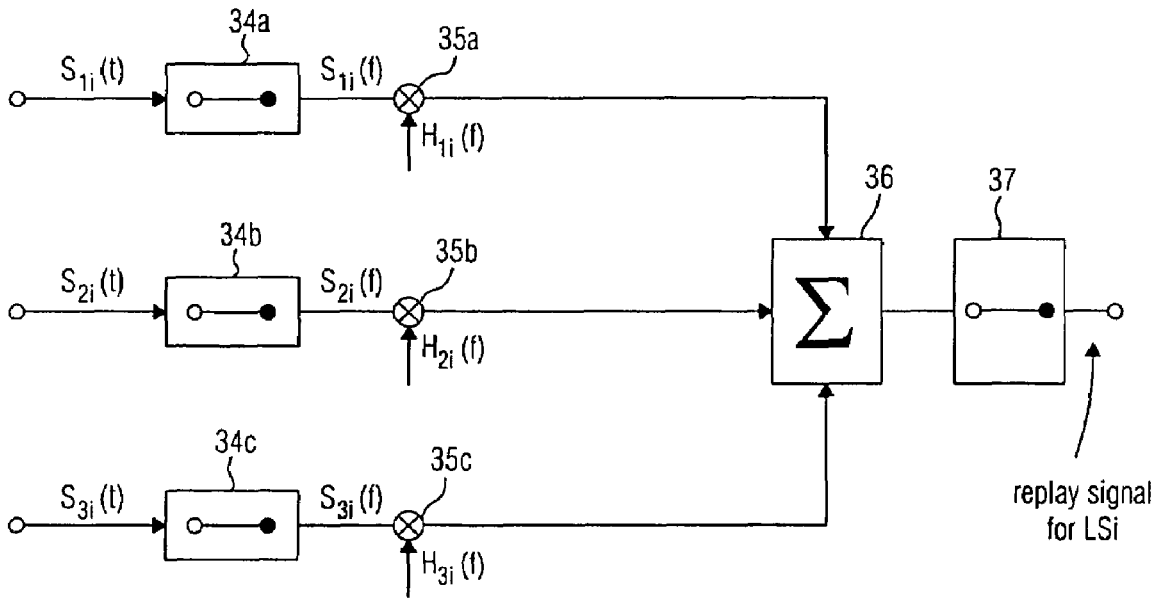

$S_{1i}(t)$:synthesis signal from virtual source to virtual position 1 for LSi;
$S_{2i}(t)$: synthesis signal from virtual source to virtual position 2 for LSi;
$S_{3i}(t)$: synthesis signal from virtual source to virtual position 3 for LSi;

$H_{1i}(f)$:transmission function for channel from virtual source to virtual position 1 to LSi;
$H_{2i}(f)$: transmission function for channel from virtual source to virtual position 2 to LSi;
$H_{3i}(f)$: transmission function for channel from virtual source to virtual position 3 to LSi;

FIGURE 4

AUDIO REPRODUCTION SYSTEM AND METHOD FOR REPRODUCING AN AUDIO SIGNAL

CROSS-REFERENCE TO RELATED APPLICATION

This application is a continuation of and claims priority to copending International Application No. PCT/EP03/13110, filed Nov. 21, 2003, which designated the United States, which claimed priority to German Patent Application No. 10254404.2-35, filed on Nov. 21, 2002, and which is incorporated herein by reference in its entirety.

BACKGROUND OF THE INVENTION

1. Field of the Invention

The present invention relates to audio reproduction systems and particularly to audio reproduction systems suitable in practice for reproduction rooms of variable size, such as cinemas, wherein the audio reproduction systems are based on the wave-field synthesis.

2. Description of the Related Art

There is an increasing demand for new technologies and innovative products in the field of consumer electronics. Thereby, it is an important prerequisite for the success of new multimedia systems that they offer optimum functionalities and capabilities, respectively. This is achieved by the usage of digital technologies and particularly computer technique. Examples therefore are applications providing an improved realistic audio visual impression. Conventional audio systems have a significant weak point in the quality of the spatial sound reproduction of natural but also virtual environments.

Methods for multi channel loudspeaker reproduction of audio signals have been known and standardized for many years. All common techniques have the disadvantages that both the site of the loudspeakers and the position of the listener are already impressed onto the transmission format. With a wrong arrangement of the loudspeakers with regard to the listener, the audio quality suffers significantly. An optimum sound is only possible in a small area of the reproduction room, the so-called sweet spot.

A better natural spatial impression as well as stronger enclosure in the audio reproduction can be obtained with the help of a new technology. The basics of this technology, the so called wave-field synthesis (WFS) have been researched at the TU Delft and have been presented for the first time in the late 80ies (Berkhout, A. J.; de Vries, D.; Vogel, P.: Acoustic control by Wave-field Synthesis. JASA 93, 1993).

Due to the huge requirements of this method with regard to computing effort and transmission rates, the wave-field synthesis has hardly been applied in practice so far. Only the progresses in the field of microprocessor technique and audio encoding allow the usage of this technology today in specific applications. First products in the professional field are expected next year. In a few years, the first wave-field synthesis applications will come on the market for the consumer field.

The basic idea of WFS is based on the application of the Huygens principle of the wave theory:

> Every point captured by a wave is the starting point of an elementary wave which propagates in a spherical or circular way.

Applied to acoustics, any form of an incoming wave front can be reproduced by a large number of loudspeakers arranged next to one another (a so-called loudspeaker array). In the simplest case, a single point source to be reproduced and a linear arrangement of the loudspeakers, the audio signals of every loudspeaker with a time delay and amplitude scaling have to be fed such that the emitted sound fields of the individual loudspeakers overlay properly. With several sound sources, the contribution to every loudspeaker is calculated separately for every source and the resulting signals are added. If the sources to be reproduced are in a room with reflecting walls, reflections also have to be reproduced via the loudspeaker array as additional sources. Thus, the effort in calculating depends strongly on the number of sound sources, the reflection characteristics of the recording room and the number of loudspeakers.

The particular advantage of this technique is that a natural spatial sound impression is possible across a large range of the reproduction room. In contrary to the known techniques, direction and distance from the sound sources are reproduced very exactly. To a limited degree, virtual sound sources can even be positioned between the real loudspeaker array and the listener.

Although the wave-field synthesis functions well for surroundings whose conditions are known, irregularities occur when the conditions change and when the wave-field synthesis is performed based on a surroundings condition, which does not correspond to the actual condition of the surroundings.

A surrounding condition can also be described by the impulse response of the surroundings.

This will be explained in more detail with regard to the following example. It is assumed that a loudspeaker emits a sound source signal against a wall whose reflection is undesirable. For this simple example, the room compensation by using the wave-field synthesis would be that first a reflection of this wall is determined in order to determine when a sound signal that has been reflected by the wall reaches the loudspeaker again and what amplitude this reflected sound signal has. When the reflection from this wall is undesirable, the wave-field synthesis offers the possibility to eliminate the reflection from this wall, by impressing a signal opposite in phase to the reflection signal into the loudspeaker with a corresponding amplitude, additionally to the original audio signal, so that the forward compensation wave eliminate the reflection wave, such that the reflection from this wall is eliminated in the surroundings that are considered. This can take place by first calculating the impulse response of the surroundings and determining the condition and position of the wall based on the impulse response of these surroundings, wherein the wall is interpreted as mirror source, which means as sound source reflecting an incident sound.

If, at first, the impulse response of these surroundings is measured and then the compensation signal is calculated, which is to be impressed to the loudspeaker overlaying the audio signal, an elimination of the reflection from this wall will take place, such that the listener in these surroundings will have the impression that this wall does not exist at all with regards to sound.

However, it is fundamental for an optimum compensation of the reflective wave that the impulse response of the room is determined exactly, so that no over- or undercompensation occurs.

Thus, the wave-field synthesis enables a correct mapping of virtual sound sources across a large reproduction range. At the same time, it offers new technical and creative potential to the recording engineer and sound engineer for the design of complex sound scenes. The wave-field synthesis (WFS or also sound-field synthesis), as it has been developed at the end of the 80ies at the TU Delft, represents a holographic approach of sound reproduction. The Kirchhoff Helmholtz integral serves as basis for this. It indicates that arbitrary sound fields within a closed volume can be generated via distribution of monopole and dipole sound sources (loudspeaker arrays) on the surface of this volume. Details about that can be found in M. M. Boone, E. N. G. Verheijen, P. F. v. Tol, "Spatial Sound-Field Reproduction by Wave-Field Synthesis", Delft University of Technology Laboratory of Seismics and Acoustics, Journal of J. Audio Eng. Soc., Vol. 43, No. 12, December 1995 and Diemer de Vries, "Sound Reinforcement by Wavefield Synthesis: Adaption of the Synthesis Operator to the Loudspeaker Directivity Characteristics", Delft University of Technology Laboratory of Seismics and Acoustics, Journal of J. Audio Eng. Soc., Vol. 44, No. 12, December 1996.

In wave-field synthesis, a synthesis signal is calculated for every loudspeaker of the loudspeaker array from an audio signal emitted by a virtual source at a virtual position, wherein the synthesis signals are formed such with regard to amplitude and phase that a wave resulting from the superposition of the sound waves output by the individual loudspeakers present in the loudspeaker array, corresponds to the wave that would originate from the virtual source at the virtual position, when this virtual source at the virtual position would be a real source with a real position.

Typically, several virtual sources are present at different virtual positions. The calculation of the synthesis signals is performed for every virtual source at every virtual position, so that typically one virtual source results in synthesis signals for several loudspeakers. Thus, seen from a loudspeaker, this loudspeaker receives several synthesis signals originating from different virtual sources. A superposition of these sources, which is possible due to the linear superposition principle, results then in the reproduction signal actually emitted by the loudspeaker.

The possibilities of wave-field synthesis can be utilized the better the larger the loudspeaker arrays are, i.e. the more individual loudspeakers are provided. However, this increases also the computing power that a wave-field synthesis unit has to perform since, typically, channel information has to be considered as well. This means that from every virtual source to every loudspeaker, basically, an individual transmission channel is present, and that, basically, the case can exist that every virtual source leads to a synthesis signal for every loudspeaker and that every loudspeaker obtains a number of synthesis signals, which is equal to the number of virtual sources, respectively.

If the possibilities of wave-field synthesis are to be exhausted in that the virtual sources can also be moveable, particularly in cinema applications, it can be realized that significant computing efforts have to be mastered due to the calculation of synthesis signals, the calculation of the channel information and the generation of the reproduction signals by combining the channel information and the synthesis signals.

Above that, it should be noted here that the quality of audio reproduction increases with the number of provided loudspeakers. This means that the audio reproduction quality becomes the better and the more realistic the more loudspeakers are present in the loudspeaker array(s).

In the above scenario, the fully rendered and analog-digital converted reproduction signals for the individual loudspeakers can, for example, be transmitted via two-wire lines from the wave-field synthesis central unit to the individual loudspeakers. This would have the advantage that it is almost guaranteed that all loudspeakers operate synchronously, so that no further measures would be required for synchronization purposes. On the other hand, the wave-field synthesis central unit could always only be produced for a specific reproduction room and for a reproduction with a fixed number of loudspeakers, respectively. This means that an individual wave-field synthesis central unit would have to be produced for every reproduction room, which has to provide a significant amount of computing power, since the calculation of the audio reproduction signals, particularly with regard to many loudspeakers and many virtual sources, respectively, has to be performed at least partially in parallel and in real time.

Particularly with regard to audio reproduction systems intended for cinemas, there is the problem that the reproduction rooms in cinemas vary significantly with regard to their size. Cinemas sometimes have a very large cinema screen and/or at the same time several small cinema screens for films having not such a high number of viewers as films to be played on large cinema screens. But different cinemas have differently sized reproduction rooms, which can vary possibly up to a factor 100, particularly when an audio reproduction is considered not only for cinemas but also, for example, for concert halls.

In order to equip such different audio reproduction rooms with an audio reproduction system based on wave-field synthesis, e.g. an individual wave-field synthesis central unit would have to be built for every reproduction room, which is not acceptable with regard to the price due to the individual production.

On the other hand, a maximally equipped wave-field synthesis central unit could be constructed, which is controllable with regard to the connectable loudspeakers, which means with regard to the number of analog signal outputs, but internally comprises computing processors, which is designed for the maximum number of analog outputs, which means connectable loudspeakers.

Such a system would lead to the fact that audio reproduction systems for smaller reproduction rooms have almost the same price as audio reproduction systems for very large reproduction rooms, which will probably not be acceptable for the operators of small reproduction rooms. Particularly medium to small reproduction rooms are interesting for providers of audio reproduction systems, wherein the "smallest" reproduction rooms should also be mentioned, which are, for example, private living rooms or smaller restaurants and bars.

Thus, the above-described possibilities are disadvantageous and that a radical market acceptance can not immediately be expected.

SUMMARY OF THE INVENTION

It is an object of the present invention to provide an audio reproduction concept having a higher market acceptance.

In accordance with a first aspect, the present invention provides an audio reproduction system for a reproduction room, wherein a plurality of loudspeakers is disposed at defined loudspeaker positions, by using an audio signal with a plurality of audio tracks, wherein an audio source position is associated to every audio track, having: a central wave-field synthesis module, formed to determine audio channel information for every audio channel from a virtual position to a loudspeaker position, wherein the virtual position depends on the audio source position associated to the audio track, so that audio channel information is present for every channel from every virtual position to every loudspeaker, calculate synthesis signals from the virtual positions for the loudspeakers, and supply one or several synthesis signals to every loudspeaker to be reproduced by the respective loudspeaker, as well as channel information for the one or the several synthesis signals; a plurality of loudspeaker modules, wherein a loudspeaker module is associated to a loudspeaker and wherein every loudspeaker module has: a receiver for receiving the one or several synthesis signals for the respective loudspeakers as well as the channel information; a rendering means for calculating a reproduction signal for the loudspeaker by using the one or several synthesis signals and the channel information for the respective loudspeaker; and a signal processing means for generating an analog loudspeaker signal, which can be supplied to the respective loudspeaker due to the reproduction signal; and a plurality of transmission lines from the central wave-field synthesis module to every loudspeaker, wherein every transmission path is coupled to the central wave-field synthesis module on the one hand and to an individual loudspeaker module on the other hand.

In accordance with a second aspect, the present invention provides a method for reproducing an audio signal in a reproduction room, wherein a plurality of loudspeakers are disposed at defined loudspeaker positions, wherein the audio signal has a plurality of audio tracks, wherein a audio source position is associated to every audio track, having the following steps: centrally determining audio channel information for every audio channel from a virtual position to a loudspeaker position, wherein the virtual position depends on the audio source position associated to the audio track, so that audio channel information is present for every channel from every virtual position to every loudspeaker; centrally determining synthesis signals from the virtual positions for the loudspeakers; transmitting of one or several synthesis signals as well as associated channel information to a plurality of loudspeaker modules; decentrally calculating a reproduction signal for the loudspeaker by using one or several synthesis signals and the associated channel information for a respective loudspeaker; performing a signal processing by using a digital/analog conversion to generate an analog loudspeaker signal; and collectively retrieving the analog loudspeaker signals through the plurality of loudspeakers.

In accordance with a third aspect, the present invention provides a computer program as a program code for performing a method for reproducing an audio signal in a reproduction room, wherein a plurality of loudspeakers are disposed at defined loudspeaker positions, wherein the audio signal has a plurality of audio tracks, wherein a audio source position is associated to every audio track, having the following steps: centrally determining audio channel information for every audio channel from a virtual position to a loudspeaker position, wherein the virtual position depends on the audio source position associated to the audio track, so that audio channel information is present for every channel from every virtual position to every loudspeaker; centrally determining synthesis signals from the virtual positions for the loudspeakers; transmitting of one or several synthesis signals as well as associated channel information to a plurality of loudspeaker modules; decentrally calculating a reproduction signal for the loudspeaker by using one or several synthesis signals and the associated channel information for a respective loudspeaker; performing a signal processing by using a digital/analog conversion to generate an analog loudspeaker signal; and collectively retrieving the analog loudspeaker signals through the plurality of loudspeakers; when the program runs on a computer.

The present invention is based on the knowledge that audio reproduction systems which are to achieve a market acceptance, have to be scalable. However, the scalability must not only take place with regard to the provided computing power but must also have an effect on the price of the audio reproduction system. In other words, this means that an audio reproduction system for a large reproduction room can cost more than an audio reproduction system for a small reproduction room. In other words, an audio reproduction system for a smaller reproduction room has to cost significantly less than an audio reproduction system for a large reproduction room.

In the above-described possible concepts, the price differences were insignificant, since price differences were only caused by the number of individual loudspeakers, which can, however, be offered inexpensively due to the fact that a lot of loudspeakers are provided and due to novel integration concepts into the building comprising the reproduction room.

According to the invention, the audio reproduction system is divided into a central wave-field synthesis module and into many individual loudspeaker modules connected to the central wave-field synthesis module in a distributed way. The central wave-field synthesis module receives an audio signal with a plurality of audio traces and calculates, on the one hand, the synthesis signals, and, on the other hand, the channel information for the channels from the virtual positions to the real loudspeaker positions.

Further, the central wave-field synthesis module is formed to supply one or several synthesis signals to every loudspeaker, which are to be reproduced by the respective loudspeaker, as well as to provide channel information for the audio channels from the virtual positions or the virtual sources from which the one or the several synthesis signals originate, to the respective loudspeaker. Here, already, a significant data rate transmission limitation can be obtained, since experience shows that the case that every loudspeaker receives synthesis signals, whose energy content is larger than a certain threshold, occurs very rarely. Thus, the inventive central wave-field synthesis module has already the option to supply only the synthesis signal and further only the channel information for the synthesis signals, which are significant for the individual loudspeaker, to a distributed loudspeaker module.

The inventive loudspeaker modules are embodied in a distributed way and immediately coupled to the loudspeaker and preferably disposed in spatial proximity to the loudspeaker, respectively. Every loudspeaker module comprises a receiver for receiving one or several synthesis signals for the respective loudspeaker as well as the channel information associated to the synthesis signals. Further, every loudspeaker module comprises a rendering means for calculating a reproduction signal for the loudspeaker by using the synthesis signal and channel information for the supplied synthesis signals. Finally, every loudspeaker module comprises a signal processing means with possibly one digital amplifier, further digital signal processing means as well as, finally, a digital-analog converter for generating an analog loudspeaker signal to be supplied to the respective loudspeaker due to the reproduction signal. For connecting the central wave-field synthesis module and the distributed loudspeaker modules, a plurality of transmission paths is provided, wherein each transmission path extends from the central wave-field synthesis module to the individual loudspeaker.

The operation of rendering is very computing-intense, which contributes significantly to the cost with regard to the required circuit hardware in the form of, for example, DSP or a hard wired circuit, particularly when considering the multiplier provided for every individual loudspeaker. Preferably, the rendering means operates by using channel impulse responses as channel information and performs thus a computing-time intensive convolution, which can either be performed directly in the time domain or in the frequency domain, wherein transformations into the frequency domain and transformations from the frequency domain are required, which leads to a significant effort together with the actual multiplication operation in the frequency domain. Here, it should particularly be noted that a rendering unit does not only have to render an individual synthesis signal but always a large number of synthesis signals, which normally corresponds to the number of virtual sources.

The inventive concept leads to the fact that operations, which can be performed in a distributed way, are shifted out of the central wave-field synthesis module into the distributed loudspeaker modules, such that in the best case only those operations are performed in the central wave-field synthesis module, which have an equal significance for all loudspeakers, while all operations concerning only one loudspeaker or several loudspeakers connected to a loudspeaker module are performed in a distributed way in the loudspeaker module.

Thereby, the cost for the central wave-field synthesis module can be reduced significantly, but only at the expense of the loudspeaker modules whose price is no longer negligible due to the operation of audio rendering mainly performed in the loudspeaker modules.

However, the inventive audio reproduction system is now scalable both with regard to performance as well as price. There is the possibility to offer a central wave-field synthesis module for a large number of reproduction rooms at a reduced price, such that the cost for the overall system resulting from the cost for the central unit and the distributed loudspeaker modules now corresponds strongly to the number of installed loudspeakers and thus the size of the reproduction room.

In other words, an operator of a large reproduction room will still have to pay a certain price for a reproduction system for his large reproduction room. On the other hand, an operator of a smaller reproduction room will be able to buy an audio reproduction system at a significantly lower price, since the number of loudspeakers and thus the number of expensive and cost-intensive loudspeaker modules is significantly reduced compared to the large reproduction room.

Thus, the inventive audio reproduction system allows to offer audio reproduction systems for smaller reproduction rooms at significantly reduced prices compared to large reproduction rooms, so that a market acceptance on the very competitive market of audio/video components is expected due to the reduced price.

In a preferred embodiment of the present invention, the central wave-field synthesis unit is formed in order to be able to process cinema films recorded in the conventional audio format for cinema films, wherein common recording formats are, for example, the 5.1 surround format or the 7.1 format or the 10.2 format. In the example of the 5.1 format, such a cinema film comprises six audio tracks, which means audio tracks for the channel "back left", "back right", "front left", "front right" and "front middle", as well as the subwoofer channel. A reproduction of such a cinema film, which is conventional with regard to the audio technique, in the inventive audio reproduction system can be obtained by placing the audio tracks as virtual sources at virtual positions, which can be chosen depending on preferences of the sound engineer and the operator of the reproduction room, respectively. Thus, the possibility of compatible reproduction for an audio reproduction system with scalable price offers a contribution that audio reproduction systems based on the wave-field synthesis already spread at a time where only very few cinema/video films exist with fully wave-field synthesis suitable audio tracks together with the respectively required meta information about the recording setting.

BRIEF DESCRIPTION OF THE DRAWINGS

These and other objects and features of the present invention will become clear from the following description taken in conjunction with the accompanying drawings, in which:

FIG. 4 is a block diagram of a preferred embodiment of the audio rendering unit in a distributed loudspeaker module;

DETAILED DESCRIPTION OF EXEMPLARY EMBODIMENTS

Figure 1:
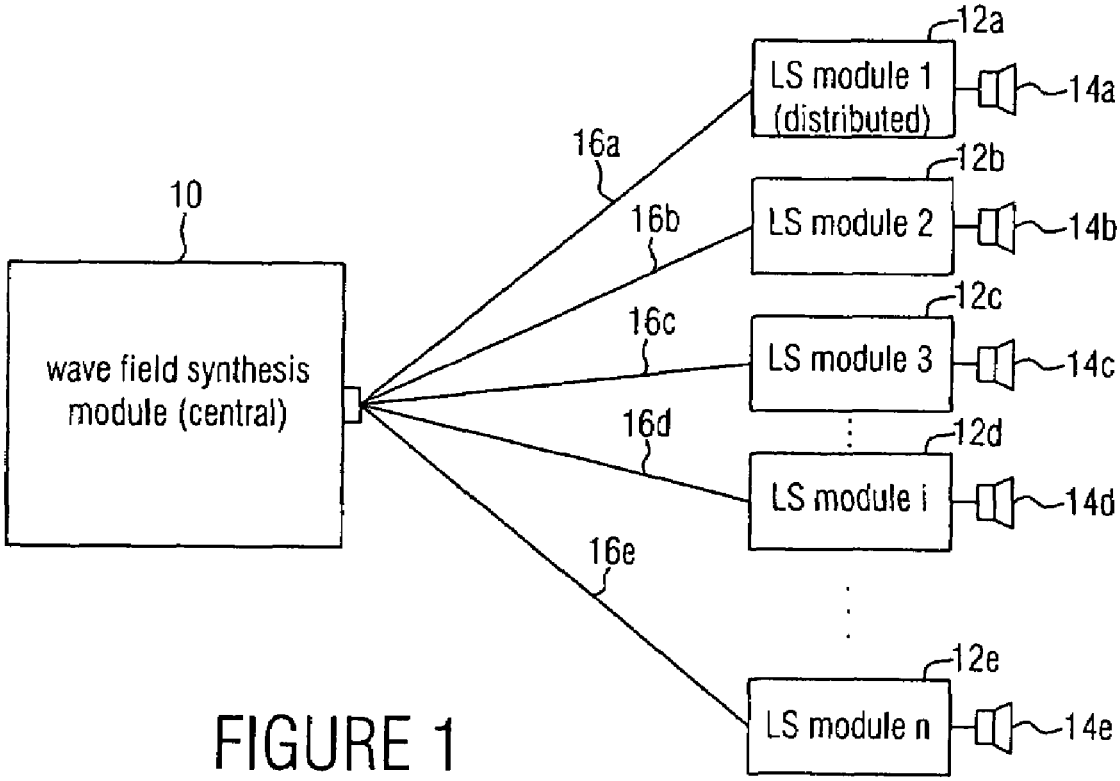
FIG. 1 is a conceptional diagram of the inventive audio reproduction system.

The inventive reproduction system is divided basically in two parts, as it is illustrated in FIG. 1. One part is the central wave-field synthesis module 10. The other part consists of individual loudspeaker modules 12*a*, 12*b*, 12*c*, 12*d*, 12*e*, which are connected to actual physical loudspeakers 14*a*, 14*b*, 14*c*, 14*d*, 14*e* as it is shown in FIG. 1. It should be noted that the number of loudspeakers 14*a*-14*e* in typical areas is in the range above 50 and typically significantly above 100. If an individual loudspeaker module is associated to every loudspeaker, the corresponding number of loudspeaker modules is required as well. Depending on the application, it is preferred to address a small group of adjacent loudspeakers from one loudspeaker module. In this context, it does not matter whether a loudspeaker module, which is connected, e.g., to four loudspeakers, supplies the four loudspeakers with the same reproduction signal or whether respective different synthesis signals are calculated for the four loudspeakers, so that such a loudspeaker module consists actually of several individual loudspeaker modules which are, however, physically integrated in one unit.

An individual transmitter path 16*a*-16*e* exists between the wave-field synthesis module 10 and every individual loudspeaker module 12*a*-12*e*, wherein every transmission path is coupled to the central wave-field synthesis module and an individual loudspeaker module.

A serial transmission format providing a high data rate is preferred as data transmission mode for transmitting data from the wave-field synthesis module to a loudspeaker module, such as a so called firewire transmission format or a USB data format. Data transmission rates of more than 100 megabit per second are advantageous.

The data stream transmitted from the wave-field synthesis module 10 to a loudspeaker module is thus formatted correspondingly in the wave-field synthesis module depending on the selected data format and provided with synchronization formation, which is provided in common serial data formats. This synchronization information is extracted from the data stream by the individual loudspeaker modules and used to synchronize the individual loudspeaker modules with regard to their reproduction, which means to the analog/digital conversion for obtaining the analog loudspeaker signal and the resampling provided therefore. It is preferred that the central wave-field synthesis module operates as master and that all loudspeaker modules operate as clients, wherein the individual data streams all obtain the same synchronization information from the central module 10 via the different transmission paths 16*a*-16*e*. This ensures that all loudspeaker modules operate synchronously, which means synchronized by the master 10, which is important for the present audio reproduction system in order not to suffer any loss of audio quality, so that the synthesis signals calculated by the wave-field synthesis module are not emitted offset in time to the individual loudspeakers after the respective audio rendering. The advantage of this concept is that the individual loudspeaker modules do not have to be synchronized to each other. They are automatically synchronized to each other, since they all run synchronously to the master. A connection of the individual loudspeaker modules among each other is unfavorable for the present invention, since the modular concept of scalability with the loudspeaker module with regard to the reproduction room size requires a simple adding of modules, without having to achieve corresponding wirings among the modules.

Figure 2:
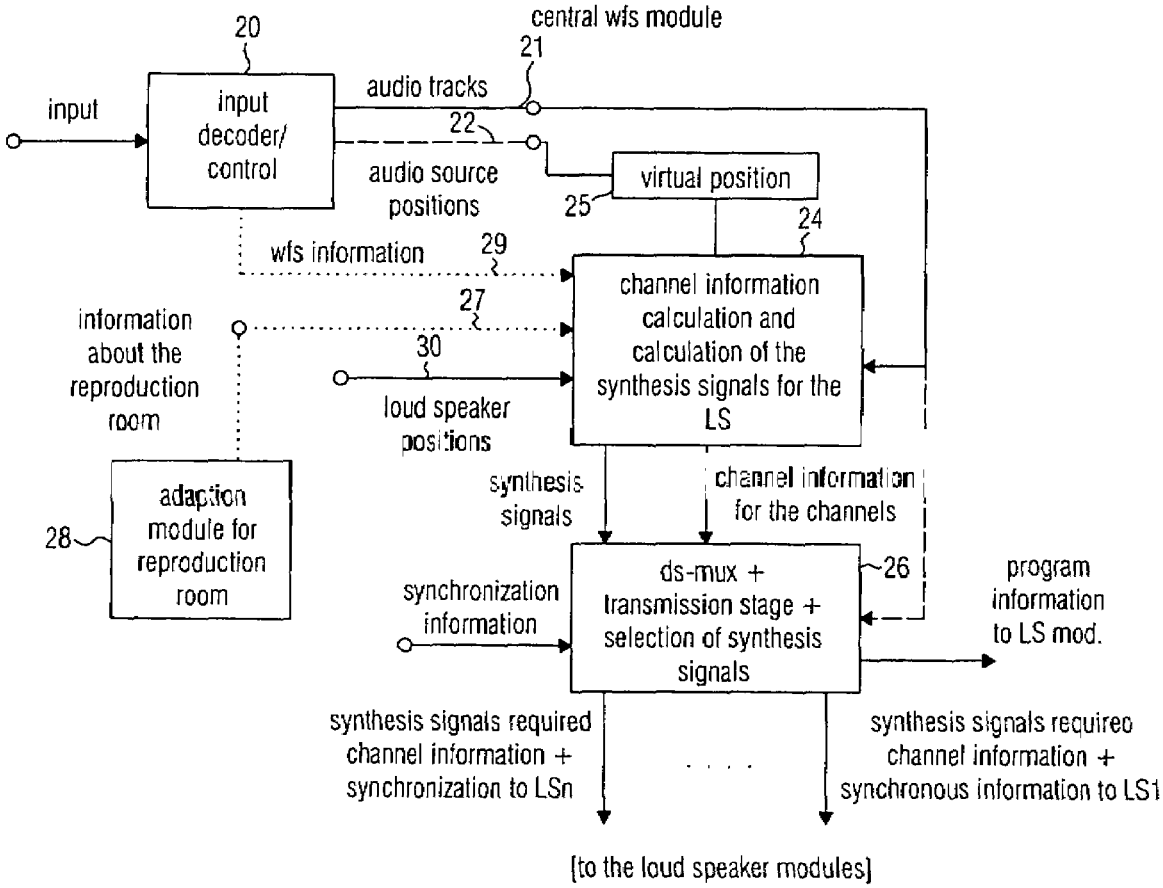
FIG. 2 is a block diagram of the inventive central wave-field synthesis module.

FIG. 2 shows a block diagram of a central wave-field synthesis module according to a preferred embodiment of the present invention. First, the central wave-field synthesis module comprises an input means 20, which is generally formed to receive an audio signal at an input, wherein the audio signal has a plurality of audio tracks, wherein an audio source position is associated to every audio track.

Depending on the application, the audio source position is an indication about the position of a loudspeaker with regard to a listener in the reproduction room according to a standardized audio format, such as 5.1, to obtain a compatible reproduction. In this case, the audio signal would have 5+1=6 audio tracks. Alternatively, the audio signal can have a larger number of audio tracks, which are already present as wave-field synthesis suitable signals and represent audio sources and audio objects, respectively, in a real recording position, which are mapped as virtual sources in the reproduction room with regard to the audio signal reproduction by using the wave-field synthesis.

Further, in a preferred embodiment of the present invention, the input means 20 is used as main control unit which preferably has further functionalities. Particularly, it has the functionality of a decoding module as it is generally used in cinemas. Alternatively or additionally, the input means 20 is also formed as DVD decoder, which provides the separate audio channels and audio tracks, respectively.

Alternatively, the reproduction means 20 is also formed as MPEG 4 decoding module, which already provides audio tracks 21 intended for wave-field synthesis and corresponding audio source information 22. Particularly, the audio tracks 21 relate to audio signals from audio objects in a recording setting, to the position of the audio objects in the recording setting, to characteristics of audio objects, particularly with regard to the size of the audio object or the density with regard to the acoustic characteristics of the audio object.

Further, it is preferred to transmit characteristics of the recording room and the recording environment, respectively, additionally to the audio tracks 21, in order to consider them in the wave-field synthesis, if necessary. The information about the recording room and the recording surroundings, respectively, are to provide that the listener does not only get a visual but also an audio impression of the recording situation. The audience is to realize in the reproduced sound, whether the recording scene of a cinema film is, for example, in the open air or, for example, in a small room, such as a submarine. While a recording scenario in the open air provides relatively "dry" audio signals, since the recording surroundings have hardly any or no reflections respectively, the situation will be totally different in a submarine, for example. Here, the recording setting is represented by room with a lot of reflection and audio surroundings with a lot of reflection, respectively. In this case, it is preferred to record the audio tracks as dry as possible, which means without room acoustics in the recording room and to describe the room acoustics with regard to its characteristics by additional meta information, as they can be transmitted according to the standard MPEG 4 in the standardized data stream.

Further, the central wave-field synthesis module comprises a means 24 for determining, on the one hand, channel information and, on the other hand, wave-field synthesis signals for the individual loudspeakers. Therefore, further, a means 25 for converting the audio source positions 22 into virtual positions for the wave-field synthesis is provided.

Individually, means 24 is formed to determine audio channel information for every audio channel from a virtual position to a loudspeaker position, wherein the virtual position depends on the audio source position associated to the audio track (means 25), so that audio channel information exists for every channel from every virtual position to every loudspeaker. Further, means 24 is formed to calculate synthesis signals from the virtual positions for the loudspeakers by using the principles of wave-field synthesis as they have been illustrated above and as they are known.

Further, the central wave-field synthesis module in FIG. 2 comprises a means 26 for providing synthesis signals to one or several loudspeakers. Further, the means 26 is formed to transmit channel information for the transmitted synthesis information from the central wave-field synthesis module across the respective transmission paths to the individual loudspeaker modules, so that audio rendering can take place there. Depending on the embodiment, it is preferred to transmit further channel information for this channel to every synthesis signal relating to a channel from a virtual position to an actual loudspeaker. This means that the means 24 in a preferred embodiment of the present invention also provides channel information for every synthesis signal and interpolates it from calculated channel information, respectively, and provides it to means 26, so that the same can initiate a transmission to the individual loudspeaker modules. Preferably, means 26 is formed to filter out insignificant synthesis signals and to transmit neither the non-significant synthesis signals nor the associated channel information in order to save data transmission capacities. Thus, the case occurs often that a virtual source leads to significant synthesis signals only for several loudspeakers, while for all other loudspeakers in the loudspeaker array synthesis signals can be calculated as well, due to the theory of wave-field synthesis, which are, however, relatively small with regard to their performance in a certain time period and can thus be neglected with regard to a reduced data transmission amount.

Particularly, means 24 comprises functionalities, which are used to preprocess the audio signals. Above that, means 24 controls the individual loudspeaker modules particularly in that they introduce synchronization information into the data streams transmitted to the individual loudspeaker modules, either directly or in connection with the means 26 and thus obtain a central synchronization of all loudspeaker modules to the central wave-field synthesis module.

Particularly, the central wave-field synthesis module is formed to perform all processing operations, which are equal for all reproduction channels, while, according to the inventive concept, the processing operations are performed in a distributed way, which are different for the individual loudspeakers and the individual reproduction channels, respectively.

Further, means 24 is formed to perform a simulation of wave-field synthesis information for stereo signals, 5.1 signals, 7.2 signals, 10.2 signals, etc. with regard to a compatible reproduction. Therefore, the standard positions of loudspeakers with regard to a reproduction room for the standardized audio format are used as audio source positions.

Figure 5:
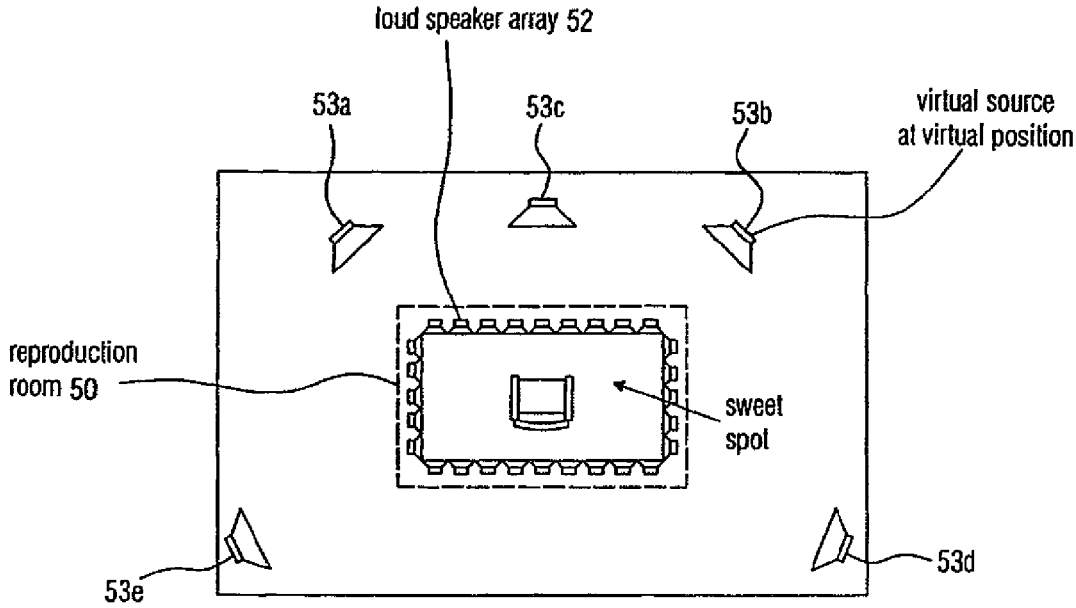
FIG. 5 is a basic representation of a compatible reproduction with large sweet spot.

In this regard, reference will be made to FIG. 5. FIG. 5 shows a reproduction room 50, a loudspeaker array 52 extending around the reproduction room as well as a number of virtual sources 53*a*-53*e*, which are positioned, as can be seen from FIG. 5, at virtual positions which are outside the reproduction room 50. Means 24 is formed in connection with means 25 of FIG. 1 to calculate virtual positions from the audio source information, which means the standard position indications for such a 5.2 signal, which can be controlled manually. Depending on the embodiment, it is preferred to shift the virtual positions, for example, into infinity, so that the loudspeaker array 52 irradiates the reproduction room 50 with planar waves. This leads to the fact that the so called sweet spot, which means the area in a reproduction room where an optimum sound impression is obtained, is significantly enlarged compared to a standard situation where real 5.1 loudspeakers are placed in the reproduction room.

Alternatively, the virtual sources can also be placed at finite virtual positions and be modeled as point sources, wherein this option has the advantage that the sound impression is more pleasant for the cinema audience/listener. Plane waves have the characteristic that the listener has the impression that he sits in a very large room, which leads to a particularly unpleasant perception when, for example, a submarine scene takes place on the screen. In this connection, it should be noted that common cinema films with, for example, 5.1 audio tracks, contain no information about acoustic characteristics of the recording setting. Thus, in such a case, it is preferred to find a compromise between the plane waves, which means the virtual sources at an infinite position or the virtual sources at a finite position. In this context, the inventive audio reproduction system further provides the possibility to vary the virtual positions of the virtual loudspeakers 53*a*-53*e* depending on the film scene. If, for example, a scene takes place in the open air, the loudspeakers can be positioned into infinity. If, however, a scene takes place in a small room, the loudspeakers can be positioned closer to the reproduction room 50.

In connection with the compatible reproduction, in a preferred embodiment of the present invention, the input means 20 is formed to sample the audio tracks associated to the video signal by a certain time "delay" before the video signals, such that after the processing in the wave-field synthesis module in the individual loudspeaker modules, the sound associated to a time is sampled at the same time to the video signal associated to a time. The negative "delay" has to be measured at least such that sound and image are emitted together in the inventive audio reproduction system. If the negative delay is larger, the signals can already be completely calculated and, for example, be output by a respective synchronization signal, which ensures synchronism of image and sound, from the loudspeaker modules to the loudspeakers.

Both in the case of the compatible reproduction and in the case where the input signal comprises already prepared wave-field synthesis information about sound sources in the recording setting, it is preferred to provide information about the reproduction room via a line 27 to the channel information calculation means 24, so that the synthesis signals can be processed by using information about the reproduction room, for example to obtain an elimination of the acoustic characteristics of the reproduction room.

Information about the reproduction room can either be determined due to the geometrical structure of the reproduction room or can be measured in the reproduction room by using the loudspeakers and specific microphone arrays, wherein control and evaluation therefore can take place via an adaptation module 28 for the reproduction room. In one embodiment of the present invention, it is preferred to determine the acoustic characteristics of the reproduction room during the reproduction and to correspondingly reset the information about the reproduction room, so that an optimum suppression of the cinema acoustic takes place, even for a, for example, full cinema. Here, it should be noted that particularly in smaller, full reproduction rooms the acoustic characteristics of the production room differ significantly from those where no people are present in the reproduction room.

Further, the adaptation module 28 for the reproduction room comprises a microphone array that can be used for measuring the characteristics of the reproduction. Further, the adaptation module 28 for the reproduction room comprises algorithms to find the position of loudspeaker arrays in the reproduction room. Further, a preprocessing of measuring results is performed to perform an optimum inverting of the room and loudspeaker characteristics, wherein the adaptation module 28 is preferably controlled by means 24.

Depending on the embodiment, the adaptation module 28 is merely required for system construction for the reproduction room. If, however, a continuous adaptation to a changed situation in the reproduction room is desired, this adaptation module 28 can also be constantly used during operation.

If the channel information calculation means 24 is used for processing of WFS specific signals input into the means 20, the additional WFS information, which means the characteristics of, for example, the audio objects and the characteristics of the recording room, will be extracted from the input audio signal and supplied to means 24 via a WFS information line 29, so that this information can be considered in the channel information calculation.

In this case, the central WFS module is further formed to perform a pre-processing of the WFS-processed audio signals. Further, the means 24 and/or means 26 is provided to obtain the synchronization between image and sound, wherein therefore, as has been explained, time codes are inserted into the preferably serial data streams to the individual loudspeaker modules. Finally, the channel information calculation means 24, as has already been explained, is also responsible for controlling the adaptation module 28 to control measuring of the acoustic characteristics of the reproduction room, if desired, either prior to reproduction or during reproduction.

The multiplexer/transmission stage 26 is formed to introduce synchronization information, which is either generated by the means 24, by the control means 20 or in the means 26 itself, into the data streams to the loudspeaker modules, which are further supplied with the synthesis signals and necessary channel information required for the individual loudspeakers.

Here, it should further be noted that the means 24 further has to be provided with the loudspeaker positions in the specific reproduction room for calculating the channel information and for calculating the synthesis signals, for calculating the individual synthesis signals and the individual channel information for the individual loudspeakers. This is illustrated symbolically in FIG. 2 by line 30.

In the following, reference will be made to a preferred embodiment for a loudspeaker module with reference to FIG. 3. First, the loudspeaker module comprises a receiver/decoder block 31 to receive the data stream from the selection means, and to extract from the same synthesis signals 31*a*, associated channel information 31*b* as well as synchronization information 31*c*. The loudspeaker module illustrated in FIG. 3 further comprises an audio rendering means 32 as central unit for calculating a reproduction signal for the loudspeaker by using the one or the several synthesis signals and by using the channel information associated to the synthesis signals. Finally, a loudspeaker module comprises a signal processing 33 with a digital/analog converter for generating an analog loudspeaker signal supplied to the respective loudspeaker LSi 34 to generate a sound signal. The signal processing means 33 and particularly the resampler cooperating with the digital/analog converter is supplied with the synchronization information (31*c*) extracted by the receiver 31 from the data stream, in order to emit the synthesis signals calculated by means 24 in FIG. 1, overlaying at the loudspeakers and provided with channel information in a time correct way, synchronously to the central wave-field synthesis module and thus synchronously to all other loudspeaker modules.

Figure 3:
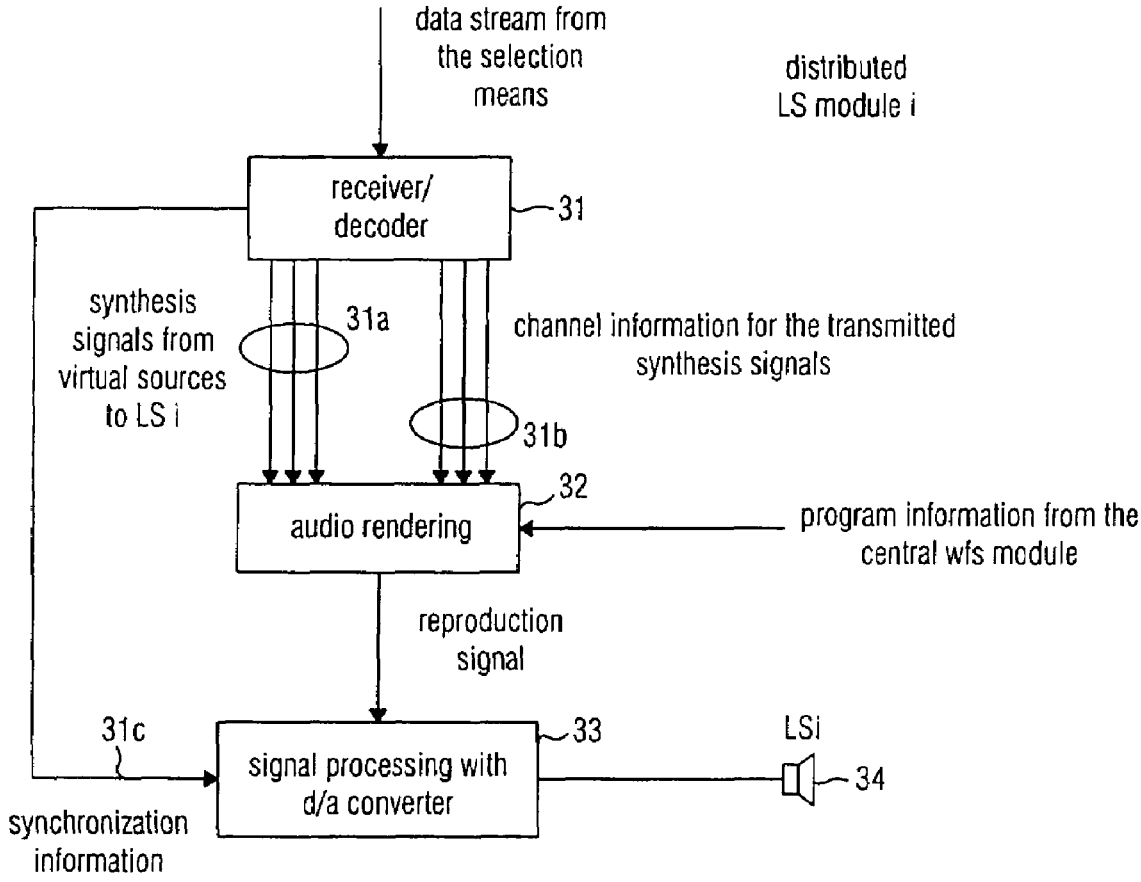
FIG. 3 is a block diagram of an inventive distributed loudspeaker module.

Thus, the loudspeaker module illustrated in FIG. 3 is distinguished by the combination of a digital receiver, another signal processing means and a digital/analog converter, wherein, particularly, a digital amplifier can be provided in the signal processing means 33. Alternatively, the signal can also be amplified after the digital/analog conversion, although the digital amplification is preferred due to the more exact possibility of synchronization. Further, it is preferred to couple the loudspeaker 34 via a short analog line to the signal processing means 33. If, however, it is not possible that the line from the signal processing means 33 to loudspeaker 34 is short, it is preferred that the respective lines for all loudspeakers have the same length and length differences, respectively, which are within a predetermined tolerance limit, since the synchronization is preferably performed on the digital side, so that with very different line lengths between the loudspeaker modules and the loudspeaker a desynchronization could occur, which could already lead to audible artifacts and to a loss of the sound impression, respectively, which is to be created by the wave-field synthesis.

In a preferred embodiment of the present invention, channel impulse responses are transmitted as channel information in the time domain or in the frequency domain. In this case, the audio rendering means 32 is designed to perform a convolution of the individual synthesis signals with the channel information associated to the synthesis signals. This convolution can actually be implemented in the time domain as convolution, or can be performed in the frequency domain by multiplying the analysis signal in the frequency domain with the channel transmission function, as required. An embodiment optimized with regard to the processing effort is illustrated in FIG. 4. FIG. 4 shows a preferred embodiment of the audio rendering means 32 and comprises a time frequency conversion block 34*a*, 34*b*, 34*c* for every synthesis signal $s_{ji}(t)$, as well as a multiplier 35*a*, 35*b*, 35*c* for every branch for multiplying the transform of a synthesis signal with the transform of a channel impulse response $H_{ji}(f)$, a summator 36 as well as terminating frequency-time conversion means 37, which are connected as illustrated in FIG. 4. The arrangement shown in FIG. 4 is distinguished by the fact that it is reduced with regard to the processing effort, in that the summation of the synthesis signals, which are already provided with the respective channel transmission functions, takes place in the frequency domain, so that only a single frequency time conversion means exists for every loudspeaker module, independent of the number of synthesis signals. Depending on the embodiment, the time frequency transformation of the synthesis signals $s_{ji}$ can be performed fully parallel, or if there is sufficient time, also serial/parallel or fully serial.

As has been shown, the preferred audio rendering means 32 shown in FIG. 4 is distinguished by the fact that it merely has a single frequency-time conversion means 37, independent of the number of synthesis signals supplied to a loudspeaker module, which is preferably implemented as inverse FFT, wherein in this case the means 34*a*, 34*b*, 34*c* are implemented as FFT (FFT=fast Fourier transformation).

The audio rendering means 32 shown in FIG. 3 is further formed to obtain special program information from the central wave-field synthesis module shown in FIG. 2. Therefore, the multiplexer/transmitting stage 26 comprises a specific output to provide the program information to the loudspeaker modules. Depending on the application case, the program information can also be multiplexed in the data stream with synthesis signals and channel information, although this is not compulsory.

In the following, an example for transmitting program information to a loudspeaker module is illustrated. If the channel information is described as channel impulse responses and transmitted to the individual loudspeaker modules, it is preferred, in the sense of data rate saving, to transmit not the whole impulse response but merely samples of the impulse response which are in a front area of the impulse response, whose envelope has an amount above a threshold. Here, it should be noted that impulse responses typically have large values at small times and increasingly assume smaller values and finally have a so called "reverberation tail", which is important for the sound impression but whose samples are no longer very high and whose specific phase relations are not perceived strongly by the ear. In this case, it is preferred to transmit the reverberation tale whose envelope is below the threshold, not based on his samples any longer but to transmit merely supporting values for the envelope. According to the invention, samples for the reverberation tail required by the audio rendering means 32 are generated by the audio rendering means generating an arbitrary sequence of zeros and ones, whose amplitude is weighted with the transmitted support values for the envelope. For further data reduction, it is preferred to transmit only a few support values and to interpolate between support values and to then use the interpolated envelope for weighting the random 0/1 sequence.

It should be noted that the random 0/1 sequence is preferably realized by positive voltage values for "1" and negative voltage values for "0". The information about whether the audio rendering means receives channel information which are actual samples up to a certain value and then merely support values for the envelope, is transmitted via the program information input shown in FIG. 3 or is fixed.

Further, the inventive wave-field synthesis module comprises a WFS mixing console not shown in FIG. 2, which comprises an author system to generate WFS sound descriptions.

Figure 6:
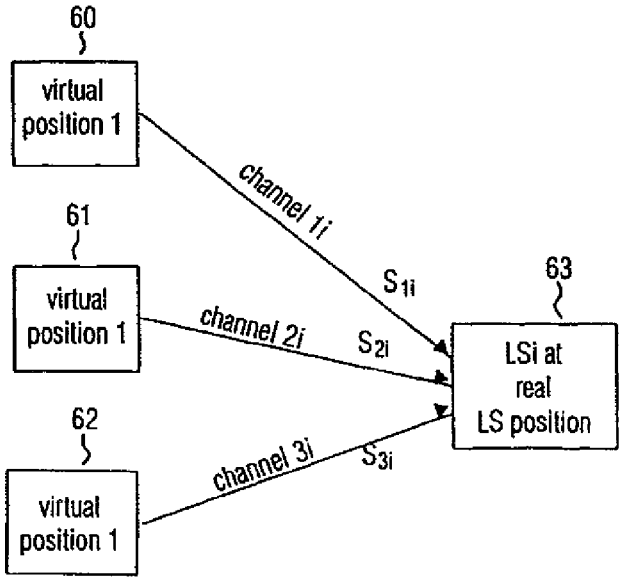
FIG. 6 is a basic drawing for the occurrence of several synthesis signals for a loudspeaker which are each provided with channel information to obtain the reproduction signal for the loudspeaker LSi.

In the following, the procedure underlying the generation of synthesis signals will be described with reference to FIG. 6. A system with three virtual sources at three virtual positions 60, 61, 62 as well as a loudspeaker LSi 63 at a real loudspeaker position known to the central WFS module is considered. Further, the virtual positions of the virtual sources 60, 61, 62 are either known to the central wave-field synthesis module in that they are supplied in a WFS-processed input signal or that they are derived by using audio source positions by the means 25 for calculating the virtual positions. The synthesis signals $s_{2i}$, $s_{2i}$ and $s_{3i}$ are the signals the loudspeaker 63 has to emit and which originate from the respective virtual positions 60, 61, 62. There from, it can be seen that every loudspeaker will emit the superposition of several synthesis signals, as has been explained.

Figure 7:
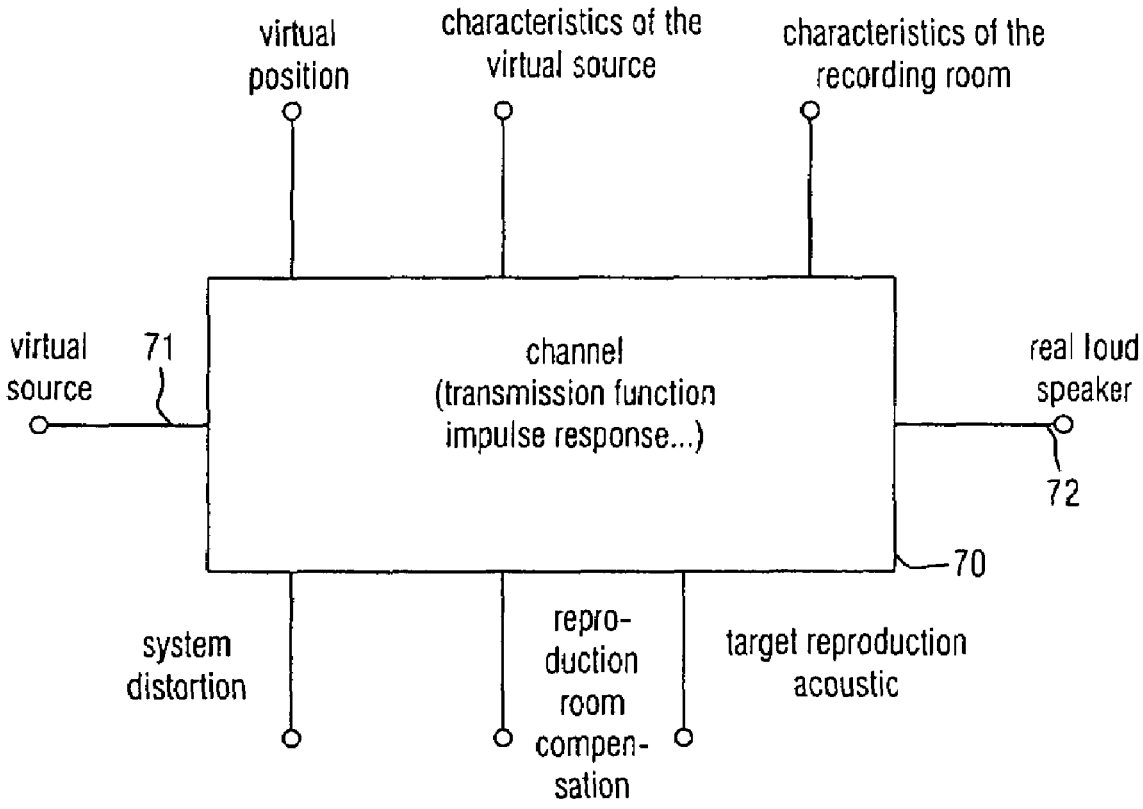
FIG. 7 is a basic representation of a channel from a virtual source to a real loudspeaker with the illustrations of the variables which can have an influence on the channel.

Further, a channel $j_i$ is defined between every virtual position every loudspeaker, which can, for example, be described by a impulse response, a transmission function or any other channel information as illustrated with reference to FIG. 7. All desired characteristics can be wrapped into the channel description to then provide the synthesis signals calculated by the wave-field synthesis modules with the channel information for the respective channel associated to a synthesis signal. If the channel information is given as an impulse response, which describes the channel, the application is a convolution. If the signals are present in the frequency domain, the provision is a multiplication. Depending on the embodiment, alternative channel information can also be used.

In the following, it will be illustrated with reference to FIG. 7, through which information a channel 70 from a virtual source 71 to a real loudspeaker 72 can be influenced. First, the virtual position of the virtual source 71 is introduced into the channel information, which means, for example, the channel impulse response. Further, characteristics of the virtual source are introduced, such as size, density, etc. Thus, for example, a small triangle will be described and modeled in a different way than a large kettledrum. Further, as has been shown in FIG. 7, the characteristics of the reproduction room are introduced into the channel transmission function. Further influencing components are a system distortion of the whole audio reproduction system, wherein, for example, loudspeaker distortion and non-idealities, respectively, of the loudspeakers are contained. Further, information about the reproduction room are introduced into the channel information to achieve a compensation of the acoustic characteristics of the reproduction room. If for example, it is known from the reproduction room that is has a wall frontally opposing a loudspeaker, which reflects, and whose reflection is to be suppressed, the respective loudspeaker is controlled under consideration of this information in that it contains a signal which is phase shifted by 180 degree to the reflected signal and has a respective amplitude, so that a deleting reflection occurs and the wall becomes acoustically transparent, i.e. no longer identifiable for the listener due to the reflections.

Finally, channel information can also be used to set a certain target reproduction acoustic. Therefore, it is preferred to first suppress the acoustic of the reproduction room in the form of a reproduction room compensation to generate channel information and provide them to the wave-field synthesis module, so that an acoustic of any other reproduction room can be simulated in a reproduction room.

Depending on the conditions, the inventive method for reproducing an audio signal can be implemented in hardware or in software. The implementation can be performed in a digital memory medium, particularly a disc or a CD with electronically readable control signals, which can cooperate with a programmable computer system such that the method is carried out. Generally, the invention consists also in a computer program product with a program code for carrying out the inventive method stored on a machine readable carrier when the computer program product runs on a computer. In other words, the invention can also be realized as computer program with a program code for performing a method when the computer program runs on a computer.

While this invention has been described in terms of several preferred embodiments, there are alterations, permutations, and equivalents, which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. An audio reproduction system for a reproduction room, in which a plurality of loudspeakers are disposed at a plurality of defined loudspeaker positions, wherein an audio signal with a plurality of audio tracks is used, wherein a different virtual audio source position is associated to each audio track of the plurality of audio tracks, the audio reproduction system comprising:

a central wave-field synthesis module, formed to determine, for each virtual audio source position of the plurality of audio tracks, audio channel information for an audio channel from the virtual audio source position to a defined loudspeaker position of the plurality of defined loudspeaker positions, wherein the audio channel information is obtained for each channel from each virtual audio source position of the plurality of audio tracks to each loudspeaker of the plurality of loudspeakers, calculate synthesis signals for the plurality of loudspeakers using amplitude scaling and time delaying the plurality of audio tracks, wherein the synthesis signals for the plurality of loudspeakers for each audio track of the plurality of audio tracks associated with the different virtual audio source positions are obtained, and supply the synthesis signals calculated for the plurality of audio tracks associated with the different virtual audio source positions and the audio channel information for each virtual audio source position of the plurality of audio tracks to each loudspeaker of the plurality of;

a plurality of loudspeaker modules, wherein each loudspeaker module of the plurality of loudspeaker modules being associated to at least one loudspeaker of the plurality of loudspeakers, and wherein each loudspeaker module of the plurality of loudspeaker modules comprises:

a receiver for receiving the synthesis signals for the respective at least one loudspeaker for each virtual audio source position of the plurality of audio tracks and the audio channel information for each virtual audio source position to the respective at least one loudspeaker;

a renderer for calculating a reproduction signal for the respective at least one loudspeaker by using the synthesis signals for each virtual audio source position of the plurality of audio tracks and the audio channel information for each virtual audio source position to the respective at least one loudspeaker; and a signal processor for generating an analog loudspeaker signal from the reproduction signal for the respective at least one loudspeaker; and a plurality of transmission paths from the central wave-field synthesis module to each loudspeaker module of the plurality of loudspeaker modules, wherein each transmission path is coupled to the central wave-field synthesis module on the one hand and to an individual loudspeaker module of the plurality of loudspeaker modules on the other hand.

2. The audio reproduction system of claim 1, wherein each loudspeaker module of the plurality of loudspeaker modules is combined with the loudspeaker to which the same is associated, so that a spatial distance between the loudspeaker and the loudspeaker module is smaller than a spatial distance between the loudspeaker module and the central wave-field synthesis module.

3. The audio reproduction system of claim 1, wherein the audio channel information is impulse responses for the audio channels.

4. The audio reproduction system of claim 3, wherein the renderer for calculating a reproduction signal has a convoluter to perform one or several convolutions by using the one or several synthesis signals with the respective impulse responses.

5. The audio reproduction system of claim 4, wherein the renderer comprises:

a time domain frequency domain converter for each synthesis signal;

a multiplier for each synthesis signal;

a summator for summing synthesis signals provided with respective channel impulse responses present in the frequency domain; and a single frequency-domain time-domain converter for converting the sum signal into the time domain to obtain the reproduction signal.

6. The audio reproduction system of claim 1, wherein the signal processor in the loudspeaker module has a digital amplifier.

7. The audio reproduction system of claim 4, wherein the central wave-field synthesis module is formed to transmit a first part of the channel impulse response sample by sample and a second part merely by using envelope support values, and wherein the renderer is formed to reconstruct the second part of the channel impulse response by using the supporting values.

8. The audio reproduction system of claim 7, wherein the renderer is formed to generate the second part of the channel impulse response by a noise generator or pseudo-noise generator, wherein noise values or pseudo noise values are weighted in amplitude with the support values and/or auxiliary values interpolated from the support values.

9. The audio reproduction system of claim 1, wherein the audio tracks are standardized multi channel tracks and the audio source positions are standard positions relating to a positioning of reproduction loudspeakers in a reproduction room, wherein the number of standard positions is equal to the number of standardized multi channel tracks.

10. The audio reproduction system of claim 9, wherein the wave-field synthesis module is formed to calculate the virtual audio source positions for calculating the audio channel information from the standard position.

11. The audio reproduction system of claim 10, wherein the wave-field synthesis module is formed to place the virtual audio source positions in infinity, so that the plurality of loudspeakers together emit plane sound waves.

12. The audio reproduction system of claim 10, wherein the wave-field synthesis module is formed to simulate virtual reproduction loudspeakers at defined virtual reproduction loudspeaker positions as point-shaped sound sources, which are so far away from the plurality of loudspeakers that an optimum reproduction region generally comprises the whole reproduction room.

13. The audio reproduction system of claim 9, wherein the audio tracks are part of a video or cinema film, wherein the wave-field synthesis module is formed to sample the audio tracks of the video or cinema films shifted by a time period prior to a video reproduction, wherein the time period is chosen to obtain a simultaneous reproduction of image and sound under consideration of a processing time in the wave-field synthesis module and the loudspeaker module.

14. The audio reproduction system of claim 1, wherein the audio signal comprises, as an audio track of the plurality of audio tracks, an audio signal of an object as well as a position of the audio object in the recording environment, one or several characteristics of the audio objects, such as size or density and/or information about acoustic characteristics of a recording environment.

15. The audio reproduction system of claim 14, wherein the wave-field synthesis module is formed to determine the virtual audio source positions from positions of the audio objects in the recording environment.

16. The audio reproduction system of claim 1, wherein the wave-field synthesis module is formed to obtain information about acoustic characteristics of the reproduction room and consider them when determining the audio channel information, so that the sound waves reproduced by the plurality of loudspeakers are formed such that the acoustic influences of the reproduction room are reduced.

17. The audio reproduction system of claim 1, wherein the wave-field synthesis module is formed to perform an adaptation to an acoustic of the reproduction room prior or during a reproduction of the audio signal, by calculating a plurality of room impulse response between the loudspeaker and microphones positioned in the reproduction room, interpolating an overall impulse response of the reproduction room from the plurality of room impulse responses, and considering the overall impulse response when calculating the audio channel information to reduce acoustic characteristics of the reproduction room.

18. The audio reproduction system of claim 1, wherein the central wave-field synthesis module is formed to generate synchronization information and to embed it into data streams to the loudspeaker modules, and wherein the plurality of loudspeaker modules is formed to receive the synchronization information from the central wave-field synthesis module and to use it for synchronization, so that the loudspeaker modules are synchronized to the central wave-field synthesis module.

19. A method for reproducing an audio signal in a reproduction room, in which a plurality of loudspeakers are disposed at a plurality of defined loudspeaker positions, wherein an audio signal with a plurality of audio tracks is used, wherein a different virtual audio source position is associated to each audio track of the plurality of audio tracks, comprising:

centrally determining, for each virtual audio source position of the plurality of audio tracks, audio channel information for an audio channel from the virtual audio source position to a defined loudspeaker position of the plurality of defined loudspeaker positions, wherein the audio channel information is obtained for each channel from each virtual audio source position of the plurality of audio tracks to each loudspeaker of the plurality of loudspeakers;

centrally determining synthesis signals for the plurality of loudspeakers using amplitude scaling and time delaying the plurality of audio tracks, wherein the synthesis signals for the plurality of loudspeakers for each audio track of the plurality of audio tracks associated with the different virtual audio source positions are obtained;

transmitting the synthesis signals calculated for the plurality of audio tracks associated with the different virtual audio source positions and the audio channel information for each virtual audio source position of the plurality of audio tracks to each loudspeaker of the plurality of loudspeakers to a plurality of loudspeaker modules, each loudspeaker module of the plurality of loudspeaker modules being associated to a respective at least one loudspeaker of the plurality of loudspeakers;

decentrally calculating a reproduction signal for the respective at least one loudspeaker by using the synthesis signals for each virtual audio source position of the plurality of audio tracks and the audio channel information for each virtual audio source position to the respective at least one; and performing a signal processing by using a digital/analog conversion of the reproduction signal for the respective at least one loudspeaker to generate an analog loudspeaker signal.

20. A digital storage medium having stored thereon a computer program having a program code for performing a method:

for reproducing an audio signal in a reproduction room, in which a plurality of loudspeakers are disposed at a plurality of defined loudspeaker positions, wherein an audio signal with a plurality of audio tracks is used, wherein a different virtual audio source position is associated to each audio track of the plurality of audio tracks, comprising:

centrally determining, for each virtual audio source position of the plurality of audio tracks, audio channel information for an audio channel from the virtual audio source position to a defined loudspeaker position of the plurality of defined loudspeaker positions, wherein the audio channel information is obtained for each channel from each virtual audio source position of the plurality of audio tracks to each loudspeaker of the plurality of loudspeakers;

centrally determining synthesis signals for the plurality of loudspeakers using amplitude scaling and time delaying the plurality of audio tracks, wherein the synthesis signals for the plurality of loudspeakers for each audio track of the plurality of audio tracks associated with the different virtual audio source positions are obtained;

transmitting the synthesis signals calculated for the plurality of audio tracks associated with the different virtual audio source positions and the audio channel information for each virtual audio source position of the plurality of audio tracks to each loudspeaker of the plurality of loudspeakers to a plurality of loudspeaker modules, each loudspeaker module of the plurality of loudspeaker modules being associated to a respective at least one loudspeaker of the plurality of loudspeakers;

decentrally calculating a reproduction signal for the respective at least one loudspeaker by using the synthesis signals for each virtual audio source position of the plurality of audio tracks and the audio channel information for each virtual audio source position to the respective at least one loudspeaker; and performing a signal processing by using a digital/analog conversion of the reproduction signal for the respective at least one loudspeaker to generate an analog loudspeaker signal.

* * * * *